US011027754B2

(12) United States Patent
Stubler

(10) Patent No.: US 11,027,754 B2
(45) Date of Patent: Jun. 8, 2021

(54) CABLE OR SIMILAR TRANSPORT INSTALLATION, AND VEHICLE SUITABLE FOR SUCH INSTALLATION

(71) Applicant: VINCI CONSTRUCTION, Rueil Malmaison (FR)

(72) Inventor: Jérôme Stubler, Paris (FR)

(73) Assignee: Vinci Construction, Rueil Malmaison (FR)

( * ) Notice: Subject to any disclaimer, the term of this patent is extended or adjusted under 35 U.S.C. 154(b) by 0 days.

(21) Appl. No.: 16/633,640

(22) PCT Filed: Jul. 24, 2018

(86) PCT No.: PCT/FR2018/051897
§ 371 (c)(1),
(2) Date: Jan. 24, 2020

(87) PCT Pub. No.: WO2019/020931
PCT Pub. Date: Jan. 31, 2019

(65) Prior Publication Data

US 2020/0377129 A1 Dec. 3, 2020

(30) Foreign Application Priority Data

Jul. 27, 2017 (FR) ..... 1757167

(51) Int. Cl.
*B61B 7/06* (2006.01)

(52) U.S. Cl.
CPC ..... *B61B 7/06* (2013.01)

(58) Field of Classification Search
CPC .... B61B 7/00; B61B 7/02; B61B 7/04; B61B 7/06; B61B 9/00
See application file for complete search history.

(56) References Cited

U.S. PATENT DOCUMENTS 3,871,303 A * 3/1975 Woodling ..... B61B 12/105 104/173.1
4,092,929 A * 6/1978 Laurent ..... B61B 12/125 104/173.1

(Continued)

FOREIGN PATENT DOCUMENTS

AU 7409481 A2 2/1983
BE 781744 A 7/1972

(Continued)

OTHER PUBLICATIONS

Written Opinion dated Nov. 21, 2018 in corresponding PCT Application No. PCT/FR2018/051897 (in English).

(Continued)

*Primary Examiner* — Jason C Smith
(74) *Attorney, Agent, or Firm* — Harness, Dickey & Pierce, PLC

(57) ABSTRACT

A transport installation includes a traction member extending in a circuit and associated with an external power source so as to be moved along the circuit, a vehicle having a power storage system, a motor system, a generator system and a fixed support adjacent to the circuit. The generator system of the vehicle includes a generator that may be activated to supply power to the storage system when the vehicle is coupled to the traction member and driven along the circuit by the traction member. The motor system of the vehicle includes a motor that may be activated to receive power from the storage system and move the vehicle relative to the fixed support.

20 Claims, 1 Drawing Sheet

(56) References Cited

U.S. PATENT DOCUMENTS

| | | | | |
|---|---|---|---|---|
| 4,187,784 | A * | 2/1980 | Fernandez | B61C 11/02 104/173.1 |
| 4,627,361 | A | 12/1986 | Tarassoff | |
| 5,517,923 | A * | 5/1996 | Cathiard | B61B 13/12 104/173.1 |
| 5,582,109 | A * | 12/1996 | Levi | B61B 9/00 104/173.1 |
| 5,595,122 | A * | 1/1997 | Levi | B61B 9/00 104/173.1 |
| 8,375,866 | B2 * | 2/2013 | Heinzle | B61B 12/125 104/202 |
| 8,418,625 | B2 * | 4/2013 | Czaloun | B61B 12/125 104/204 |
| 8,844,446 | B2 * | 9/2014 | Bavaresco | B61B 9/00 104/165 |
| 2009/0165666 | A1 * | 7/2009 | Pabst | B61B 12/06 104/112 |
| 2013/0241315 | A1 * | 9/2013 | Stollmann | B61B 7/02 307/154 |
| 2014/0012446 | A1 * | 1/2014 | Kumar | B60L 53/00 701/22 |
| 2016/0152129 | A1 * | 6/2016 | West | B60L 5/36 307/10.1 |
| 2017/0050646 | A1 * | 2/2017 | Blengini | B61B 12/022 |
| 2018/0048156 | A1 * | 2/2018 | Luger | B61B 7/04 |

FOREIGN PATENT DOCUMENTS

| | | | |
|---|---|---|---|
| CA | 952372 | A | 8/1974 |
| CN | 1313305 | C | 5/2007 |
| CN | 101269659 | A | 9/2008 |
| CN | 106132799 | A | 11/2016 |
| CN | 106255631 | A | 12/2016 |
| CN | 106414210 | A | 2/2017 |
| DE | 3109294 | A1 | 10/1982 |
| EP | 0678433 | A1 | 10/1995 |
| FR | 2961776 | A1 | 12/2011 |
| GB | 2004824 | A | 4/1979 |

OTHER PUBLICATIONS

Office Action dated Sep. 3, 2020 in related Chinese Application No. 2018800619963 with English translation.

* cited by examiner

CABLE OR SIMILAR TRANSPORT INSTALLATION, AND VEHICLE SUITABLE FOR SUCH INSTALLATION

CROSS-REFERENCE TO RELATED APPLICATIONS

This application is a National Phase Entry of International Patent Application No. PCT/FR2018/051897, filed on Jul. 24, 2018, which claims priority to French Patent Application No. 1757167, filed on Jul. 27, 2017, both of which are incorporated by reference herein.

TECHNICAL FIELD

The present description relates to installations for transporting passengers or goods.

BACKGROUND

The present description relates more particularly to transport installations using a traction member to drive one or more vehicles along a circuit. The traction member is typically a cable. Other types of members such as ropes, chains, belts, etc. may also be used for certain purposes.

Types of cable transport may take the form of cable car systems, gondola lifts, chairlifts, funiculars, trains, etc. In these installations, the vehicles, such as a trolley, cabin, cart, cable car or seat for example, usually move at the same speed as the associated traction cable.

Aerial cable transport has been used for a long time in the mountains. However, it may also be used in other environments, with more gentle slopes. For example, in urban areas, transport infrastructures have to jostle for space on the ground, particularly in city or town centers, which explains why transportation by cables, in particular aerial cables, is of interest. FR 2 961 776 A1 describes an example of an aerial tramway installation in an urban environment.

The coupling of the vehicle to the traction cable may be fixed or detachable. If it is detachable, a mechanical grip closes or opens to attach the vehicle on the cable or release it therefrom. It is thus possible to stop or reduce the speed of the vehicle at stations. In general, the vehicles travel at a lower speed at stations, being pushed by complementary systems, for example a conveyor belt or chain. An example of an installation with detachable coupling is described in EP 0 114 129 A1.

Electric vehicles are another developing means of transport, especially in urban areas. These vehicles have a system for storing electric power based on batteries, hydrogen batteries or capacitor banks. They are capable of moving autonomously, accelerating, braking, traveling at constant speed, climbing or descending slopes, recovering braking and descent energies, and they may have on-board intelligence managing multiple pieces of information related to the support on which they are running (road, rail, etc.) and their environment. They are sometimes capable of communicating with other vehicles, for example to manage distances between vehicles. One of the disadvantages of this type of vehicle is its limited autonomy and the cost of its power charging system.

One aim of the present invention is to provide greater flexibility of operation for a transport installation using cables or other traction members.

SUMMARY

The invention proposes a transport installation, comprising:

at least one traction member extending in a circuit and associated with an external power source so as to be moved along the circuit;

at least one vehicle having a power storage system, a motor system and a generator system; and at least one fixed support adjacent to the circuit.

The generator system of the vehicle comprises at least one generator that may be activated to supply power to the storage system when the vehicle is coupled to the traction member and driven along the circuit by the traction member. The motor system of the vehicle comprises at least one motor that may be activated to receive power from the storage system and move the vehicle relative to the fixed support.

The installation makes it possible to circulate one or more vehicles, being capable of harnessing the work performed by the traction member to store power with a view to supplying this power in phases in which the vehicle needs to move autonomously. It is not necessary for the vehicle to always move at the same speed as the traction member along the circuit. The installation makes it possible to optimize transport times and to travel on path sections that do not have a traction member.

The transport installation may comprise at least one vehicle loading/unloading station adjacent to at least one circuit defined by a respective traction member and comprising a fixed support for supporting the moving vehicle at the loading/unloading station. It is not essential for these loading/unloading stations to have complementary drive systems or power supplies in order for the vehicles to move there. The infrastructure may therefore be relatively simple since it is conceivable for external power to be supplied only to the traction members.

The transport installation may also comprise a vehicle travel path including a plurality of sections, each section having a traction member extending in a respective circuit between two ends of the section. A fixed support is arranged between ends of two consecutive sections of the path so that the vehicle moves between the two consecutive sections by activation of at least one motor of the motor system of the vehicle while being supported by the fixed support. The autonomy given to the vehicle(s) when not at the sections equipped with traction members makes it possible in particular to easily manage the bends in the path, without the need to have complex mechanical systems for diverting the traction members.

A vehicle suitable for the abovementioned transport installation is also provided. This vehicle comprises:

an interface for selectively coupling the vehicle to a traction member extending in a circuit;

a power storage system;

a generator system including at least one generator that may be activated to supply power to the storage system when the vehicle is coupled to the traction member and driven along the circuit by the traction member moved by an external power source; and a motor system including at least one motor that may be activated to receive power from the storage system and move the vehicle relative to a fixed support adjacent to the circuit.

In one embodiment of the vehicle, the motor system comprises at least one motor that may be controlled to move the vehicle relative to the traction member when the vehicle is moving along the circuit. The vehicle may comprise a first set of at least one wheel capable of rolling on the fixed support while being driven by a motor of the motor system, and a second set of at least one wheel capable of bearing on the traction member.

In one embodiment, at least one wheel of the second set is arranged to participate in the coupling of the vehicle to the traction member when it bears on the traction member. In addition to the coupling by the wheel, there may optionally also be a detachable mechanism such as a grip, or the like.

The coupling of the vehicle to the traction member may in particular be performed by this wheel (or these wheels) when it (they) bear(s) on the traction member, under the effect of the friction between this wheel (or these wheels) and the traction member. It will be noted that such a friction coupling does not prevent the vehicle from being able to move relative to the traction member. In particular, it is possible for one wheel of the second set (or more) to be driven, in one direction or the other, by a motor to make the vehicle travel faster or slower than the traction member, while remaining coupled thereto. It is also possible, in particular in descending portions of the path, for one wheel of the second set (or more) to actuate a generator to recover some of the power. According to one embodiment, the motor system may be adapted to control at least one of the wheels of the first and second sets so that the vehicle is moved at a speed $V_1$ relative to the fixed support and a speed $V_2$ relative to the traction member, the speeds $V_1$ and $V_2$ being such that the difference $V_1-V_2$ is equal to the speed V of movement of the traction member relative to the fixed support.

In one embodiment, at least one wheel of the first set may be controlled to send power to at least one generator of the generator system when it is driven in rotation by the movement of the vehicle coupled to the traction member. In one embodiment, at least one wheel of the second set may be driven by at least one motor of the motor system when the vehicle is coupled to the traction member so as to change the speed of movement of the vehicle relative to the speed of the traction member. In one embodiment, at least one wheel of the second set may be controlled to send power to at least one generator of the generator system when it is driven in rotation while the vehicle is supported by the fixed support.

BRIEF DESCRIPTION OF THE DRAWINGS

Further features and advantages of the present invention will emerge from the following description of non-limiting embodiments, which refers to the attached drawings, in which.

DESCRIPTION OF EMBODIMENTS

The installation shown here may be used to transport passengers and/or any kind of freight. It comprises one or more vehicles capable of traveling along one or more paths. The simple path shown schematically in FIG. 1 comprises two successive sections 10 between two loading/unloading stations 11. The sections shown are rectilinear, with a transition zone 12 between them forming a bend.

Figure 1:
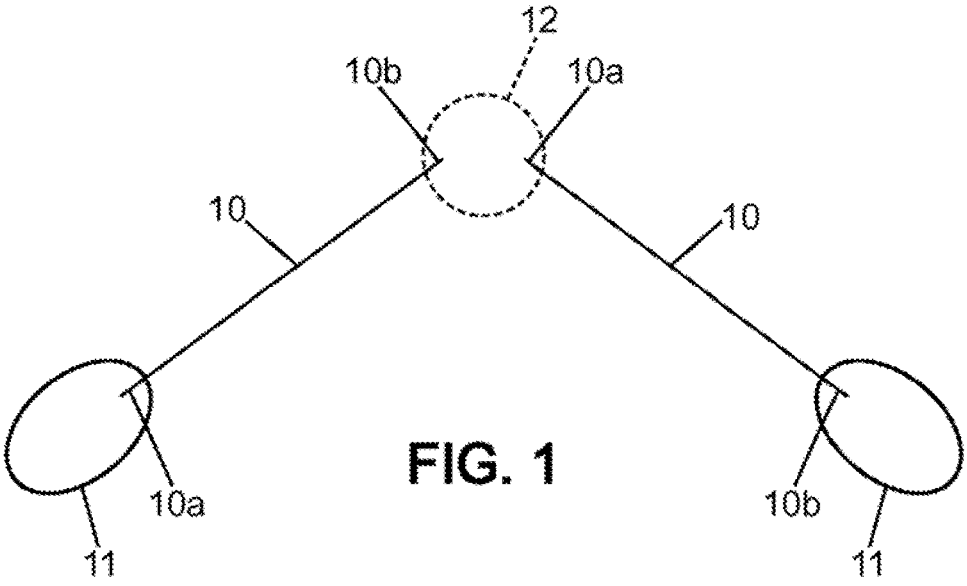
FIG. 1 is a diagram showing a simplified topology of an example of a fixed infrastructure belonging to a transport installation.

A fairly simple path is shown in FIG. 1 for the purposes of the present description. In practice, a very wide variety of paths is possible:

- a single section, rectilinear or non-rectilinear, between the start point and the finish point of the path;
- more than two consecutive, rectilinear or non-rectilinear sections, between the start point and the finish point, in which two consecutive sections may be aligned with one another, or have a bend between them, as in the case of FIG. 1;
- the sections may be organized in a network to enable vehicles to be moved between multiple stations located at the nodes of the network or at only some of these nodes; etc.

The path sections may be located at ground level, at a height (the vehicles being suspended or resting on supports constructed at a height) or underground, in tunnels. For each path section there is a corresponding traction member, taking the form of a cable 15 in the rest of the present description (FIGS. 2 and 3), although this does not have to be the case. The cable 15 is arranged in a circuit corresponding to the path section, and is driven along this circuit by one or more motors forming part of the transport infrastructure and actuated by an external power source, for example an electricity distribution network. Each cable 15 extends, for example, between two return pulleys located at the ends 10*a*, 10*b* of the section 10, and the circuit that it forms comprises a coupling portion (visible in FIGS. 2 and 3), in which the cable can engage with an interface of a vehicle 20, and, in the opposite direction, a return portion (not visible in FIGS. 2 and 3).

Optionally, one or more support pulleys may be located along the circuit to compensate for the weight of the coupling portion of the cable 15. Furthermore, if the cable section is not rectilinear, one or more deflection pulleys may be provided along this section 10. Such a deflection pulley has its axis horizontal to the changes in slope of the section 10. Its axis is inclined with respect to the horizontal if the section 10 is not rectilinear in plan view. The motor or motors for driving the cable 15 act, for example, at one or more of the aforementioned pulleys.

Figure 2:
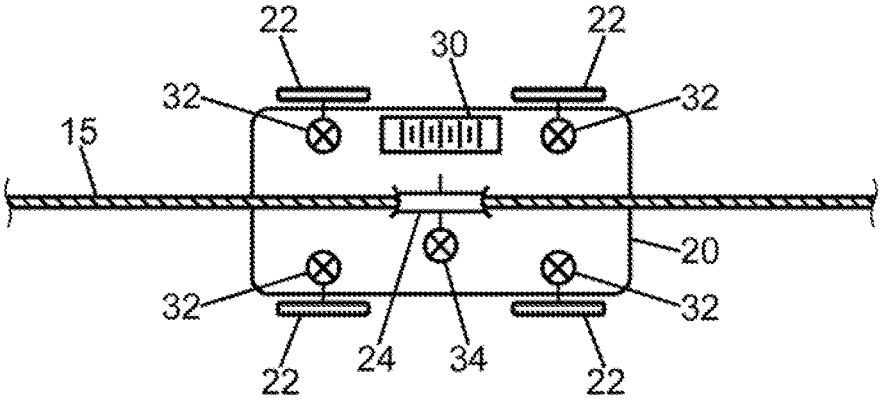
FIGS. 2 and 3 are schematic views, seen from the top and from the side, of a vehicle moving along a circuit forming part of the infrastructure.
Figure 3:
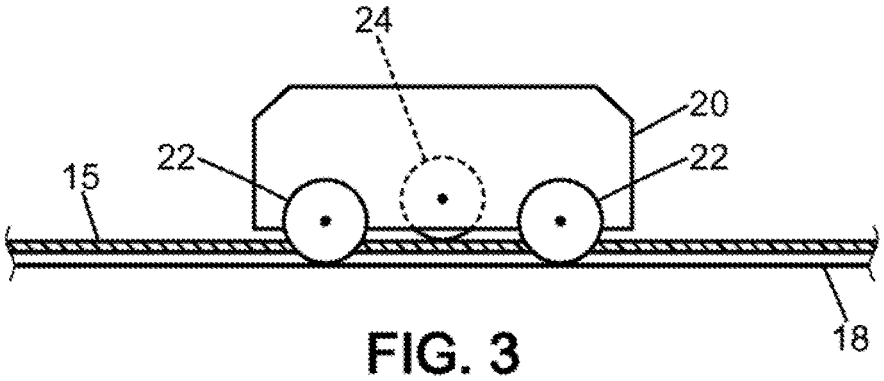

In the example shown in FIGS. 2 and 3, the traction cable 15 is located on the ground. It is also possible for the traction cable to be located at a height, above the vehicle 20 or next to the latter.

Next to the circuit or circuits followed by the cables 15, the transport installation comprises one or more fixed supports 18. In the example shown, this fixed support 18 is placed on the ground or consists of the ground itself. It will be understood that a wide variety of other fixed supports may be used, for example, rails, a deck, one or more load-bearing cables, one or more overhead beams, etc. The fixed support 18 may have, in portions of the path where this is required, a system for guiding the vehicles along their route, for example based on rails. Depending on the architecture of the installation, the fixed support 18 may be optional along the circuit or circuits formed by the traction cables 15, in particular if the cables 15 are also load-bearing, as in the case of gondolas, for example.

At the stations 11, or transition zones 12 between consecutive path sections, the fixed support 18 allows the vehicle 20 to be supported outside the circuit. At this point, the vehicle 20 can itself move relative to the fixed support 18, as explained below. If a fixed support 18 is provided along the circuit followed by a traction cable 15, it may simply be extended at the stations or transition zones, or supplemented by another fixed support. If there is no fixed support along the circuit, it may be present only at stations 11 or transition zones 12.

Each vehicle 20 of the transport installation comprises two types of mechanical interface:

- a first type for the interface of the vehicle with the fixed support 18;
- a second type for the interface of the vehicle with the traction member 15.

When the fixed support 18 is on the ground, or more generally under the vehicle 20, the interface of the first type may conveniently be composed of a set of one or more wheels 22. In the non-limiting example shown in FIGS. 2 and 3, this first set comprises four wheels 22 distributed around the vehicle 20 and resting on the ground 18. A brake (not shown) may be used to lock the wheels 22 when the vehicle 20 must not move relative to the fixed support 18.

As the traction member is a cable 15, the interface of the second type may also be composed of a set of one or more wheels 24. In the non-limiting example shown in FIGS. 2 and 3, this second set comprises a single wheel which has access to the cable 15 under the vehicle 20.

The coupling of the vehicle 20 to the traction cable 15 may be performed by means of one or more wheels 24 of the second set. In particular, the coupling may be performed by friction. An actuator (not shown) biases the wheel 24 toward the cable 15 so that its periphery is pressed onto the cable 15, thereby creating the coupling. A brake (not shown) locks the wheel 24 when the vehicle 20 is to move at the same speed as the traction cable 15. In order to prevent uncoupling between the wheel 24 and the cable 15, it is possible to provide an annular groove at the periphery of the wheel 24, which thus engages the cable in the manner of a pulley.

Alternatively, it is possible to use a detachable grip for coupling the vehicle 20 to the traction cable 15. A detachable grip may in particular be provided in addition to the friction coupling with the wheel 24 in the case where the path of the vehicle comprises portions with a significant slope.

The vehicle 20 further comprises a power storage system 30, a motor system and a generator system. The power used is conveniently electric power. The storage system 30 thus includes one or more batteries. Other forms of power (pneumatic, mechanical, etc.) are in principle usable as an alternative.

The battery 30 may be charged by means of the generator system, and it can supply electric power to the motor system. In the particular case shown in FIG. 2, each of the wheels 22, 24 of the interfaces of the first and second types has its axle connected to a direct current (DC) rotating machine 32, 34 which may be used either in generator mode for charging the battery 30, or in motor mode for driving the wheels 22, 24. The generator system thus comprises the generators 32, 34 consisting of the DC machines operated in generator mode, while the motor system comprises the motors 32, 34 consisting of the DC machines operated in motor mode. Naturally, the elements of the motor system may also be separate from the elements of the generator system. It is also possible to associate only some of the wheels with elements of the motor system, and only some of the wheels with elements of the generator system. On the other hand, the same motor, or the same generator, may be associated with several wheels at the same time by a suitable transmission mechanism. The DC machines 32, 34 may also be used to selectively brake or lock the wheels 22, 24.

The DC machines 32, 34 are controlled by a controller (not shown) on board the vehicle 20. The controller may include one or more processors executing programs written to control the operating phases of the vehicle while managing the electrical power stored in the battery 30. The controller may be associated with one or more wireless interfaces to communicate with control members of the fixed infrastructure of the transport installation, and/or with controllers of other vehicles of the installation.

The vehicles 20 may be controlled in many different ways, resulting in a great ease of operation of the transport installation. Some examples are discussed below.

When the wheel 24 is coupled to a traction cable 15 and locked in rotation, the vehicle 20 travels along the circuit formed by this cable at the speed at which the cable is driven. The DC machines 32 (or only some of them) are placed in generator mode and actuated by the wheels 22 which roll on the fixed support 18. In this case, the external power used to drive the cable 15 and the vehicle 20 also serves to charge the battery 30. When the battery 30 is full, the generators 32 may be deactivated to allow each wheel 22 rotate as a free wheel.

While remaining coupled to the traction cable 15 by the frictional force, the wheel 24 may be driven in rotation either in one direction or in the other by the DC machine 34 placed in motor mode. In this case, the speed of travel of the vehicle 20 is varied with respect to the running speed of the traction cable 15, which gives rise to a capacity for managing the flow of traffic in the transport installation. When the vehicle is to travel less quickly than the traction cable 15, another possibility is to use the DC machine 34 in generator mode to recover some of the braking energy and thus power the battery 30.

In another mode of operation of the vehicle 20, the latter is at a stop at a location on the circuit, with its wheels 22 locked. The wheel 24, still coupled to the moving traction cable 15, drives the DC machine 34 in generator mode to charge the battery 30 using the power coming from the external source. When the battery 30 is full, the generator 34 may be deactivated to decouple the wheel 24 from the traction cable.

The controller of the vehicle 20 manages the phases of acceleration and deceleration of the vehicle by means of the motors 32, 34 associated with the wheels 22, 24, taking into account the running speed V of the cable 15. By varying the speeds of the various motors, the controller causes the vehicle to accelerate or decelerate. When the desired speeds are reached, the wheel 24 may be coupled to the cable or decoupled. It is not necessary to arrange a special mechanism to ensure smooth transitions between the cable zones and the non-cable zones or to accelerate or decelerate the vehicle 20.

The controller may control one or more of the wheels 22 so that the vehicle 20 travels at a speed $V_1$ with respect to the fixed support 18, the friction coupling between the wheel 24 and the cable 15 thus ensuring that the vehicle moves relative to the cable 15 at a speed $V_2=V_1-V$. By increasing, or decreasing, the speed $V_1$ the controller thus sets a phase of acceleration, or deceleration, of the vehicle. In the conventions used here, the speeds $V_1$ and $V_2$ of the vehicle 20 are positive when they have the same orientation as the speed V at which the cable 15 is running with respect to the fixed support 18, and negative otherwise.

Alternatively, the controller may control the wheel 24 so as to set the speed $V_2$ of the vehicle 20 relative to the cable 15, the friction coupling between the wheels 22 and the fixed support 18 thus ensuring that the vehicle moves relative to the fixed support at a speed $V_1=V_2+V$. By increasing, or decreasing, the speed $V_2$, the controller thus sets a phase of deceleration, or acceleration, of the vehicle. According to a further alternative, the controller controls the motors 32, 34 so as to simultaneously set the speeds $V_1$ and $V_2$, while still fulfilling the equation $V=V_1-V_2$, which prevents slipping.

In the zones where a traction cable 15 is not available, for example the station zones 11 or the transition zones 12 shown schematically in FIG. 1, the power stored in the battery 30 is used to control the motors 32 associated with the wheels 22 in order to perform the necessary movements of the vehicle 20. It is thus possible to stop the vehicles at the stations for loading or unloading, to bring them to parking places or to maintenance stations, to put into service new vehicles, etc.

This mode of operation is useful in bend zones 12 of the paths, to avoid the need for complex mechanisms to create a substantial angular diversion of the cables while keeping the vehicle coupled to the cable to negotiate the bend. When the vehicle passes from a first path section to a second path section in a transition zone 12, the controller controls the DC Machines 32, 34 powered from the battery 30 so that the vehicle 20 smoothly leaves the traction cable 15 of the first section, carries on autonomously toward the second section, reaches the traction cable 15 of the second section and smoothly couples thereto to continue on its route. A simple passive guide mechanism, rail-based or of another type, may be provided near the end 10*a*, 10*b* of the path section in order to guide the vehicle 20 while ensuring that its wheel 34 engages properly on the traction cable 15.

It is possible to arrange a loading/unloading station at a place where a traction cable 15 runs without interruption. The controller of the vehicle thus manages the required phases of acceleration and deceleration in the vicinity of such a station by controlling the DC machines 32, 34. The fact that the phases of acceleration and deceleration are managed using the motors 32, 34 avoids having to absorb the acceleration/deceleration by the friction of the wheels 22, 24, which is advantageous from the viewpoint of durability of the parts of the vehicle.

One advantage of the vehicle 20 is that its battery 30 may be relatively small, and therefore inexpensive. To be specific, there are plenty of opportunities to charge the battery 30 while the vehicle is moving, and therefore there is no need for a large storage capacity. The fact that the traffic of vehicles 20 is managed by means of on-board motors and controllers optionally interacting with a centralized control makes it possible to optimize traffic by adjusting traffic speeds, something which cannot be done with conventional cable transport systems.

The embodiments described above are a simple illustration of the present invention. Various modifications may be made thereto without departing from the scope of the invention defined by the appended claims.

The invention claimed is:

1. A transport installation, comprising:

at least one traction member extending along a circuit and associated with an external power source so as to be moved along the circuit;

at least one vehicle having a power storage system, a motor system and a generator system; and at least one fixed support adjacent to the circuit;

the generator system of the vehicle comprising at least one generator that may be activated to supply power to the storage system when the vehicle is coupled to the traction member and driven along the circuit by the traction member; and the motor system of the vehicle comprising at least one motor that may be activated to receive power from the storage system and move the vehicle relative to the fixed support.

2. The transport installation as claimed in claim 1, comprising at least one vehicle loading/unloading station, adjacent to at least one circuit defined by a respective traction member and comprising a fixed support operably supporting the moving vehicle at the loading/unloading station.

3. The transport installation as claimed in claim 1, comprising a vehicle travel path including a plurality of sections, each section having a traction member extending along a respective circuit between two ends of the section and a fixed support being arranged between ends of two consecutive sections of the path so that the vehicle moves between the two consecutive sections by activation of at least one motor of the motor system of the vehicle while being supported by the fixed support.

4. The transport installation as claimed in claim 1, wherein the motor system of the vehicle comprises at least one motor that may be controlled to move the vehicle relative to the traction member when the vehicle is moving along the circuit.

5. The transport installation as claimed in claim 1, wherein the vehicle comprises a first set of at least one wheel capable of rolling on the fixed support while being driven by a motor of the motor system of the vehicle, and a second set of at least one wheel capable of bearing on the traction member.

6. The transport installation as claimed in claim 5, wherein at least one wheel of the second set is arranged to participate in the coupling of the vehicle to the traction member when it bears on the traction member.

7. The transport installation as claimed in claim 6, wherein at least one wheel of the second set is arranged to perform the coupling of the vehicle to the traction member when it bears on the traction member, under the effect of the friction between the at least one wheel of the second set and the traction member.

8. The transport installation as claimed in claim 7, wherein the motor system of the vehicle is adapted to control at least one of the wheels of the first and second sets so that the vehicle is moved at a speed $V_1$ relative to the fixed support and a speed $V_2$ relative to the traction member, the speeds $V_1$ and $V_2$ being such that the difference $V_1$-$V_2$ is equal to the speed V of movement of the traction member relative to the fixed support.

9. The transport installation as claimed in claim 5, wherein at least one wheel of the first set may be controlled to send power to at least one generator of the generator system when it is driven in rotation by the movement of the vehicle coupled to the traction member.

10. The transport installation as claimed in claim 5, wherein at least one wheel of the second set may be driven by at least one motor of the motor system of the vehicle when the vehicle is coupled to the traction member so as to change the speed of movement of the vehicle relative to the speed of the traction member.

11. The transport installation as claimed in claim 5, wherein at least one wheel of the second set may be controlled to send power to at least one generator of the generator system of the vehicle when it is driven in rotation while the vehicle is supported by the fixed support at a speed of movement which is zero or less than the speed of movement of the traction member.

12. A vehicle, comprising:

an interface selectively coupling the vehicle to a traction member extending in a circuit;

a power storage system;

a generator system including at least one generator that may be activated to supply power to the storage system when the vehicle is coupled to the traction member and driven along the circuit by the traction member moved by an external power source; and a motor system including at least one motor that may be activated to receive power from the storage system and move the vehicle relative to a fixed support adjacent to the circuit.

13. The vehicle as claimed in claim 12, wherein the motor system comprises at least one motor that may be controlled to move the vehicle relative to the traction member when the vehicle is moving along the circuit.

14. The vehicle as claimed in claim 12, comprising a first set of at least one wheel capable of rolling on the fixed support while being driven by a motor of the motor system, and a second set of at least one wheel capable of bearing on the traction member.

15. The vehicle as claimed in claim 14, wherein at least one wheel of the second set is arranged to participate in the coupling of the vehicle to the traction member when it bears on the traction member.

16. The vehicle as claimed in claim 15, wherein at least one wheel of the second set is arranged to perform the coupling of the vehicle to the traction member when it bears on the traction member, under the effect of the friction between the at least one wheel of the second set and the traction member.

17. The vehicle as claimed in claim 16, wherein the motor system is adapted to control at least one of the wheels of the first and second sets so that the vehicle is moved at a speed $V_1$ relative to the fixed support and a speed $V_2$ relative to the traction member, the speeds $V_1$ and $V_2$ being such that the difference $V_1$-$V_2$ is equal to the speed V of movement of the traction member relative to the fixed support.

18. The vehicle as claimed in claim 14, wherein at least one wheel of the first set may be controlled to send power to at least one generator of the generator system of the vehicle when it is driven in rotation by the movement of the vehicle coupled to the traction member.

19. The vehicle as claimed in claim 14, wherein at least one wheel of the second set may be driven by at least one motor of the motor system when the vehicle is coupled to the traction member so as to change the speed of movement of the vehicle relative to the speed of the traction member.

20. The vehicle as claimed in claim 14, wherein at least one wheel of the second set may be controlled to send power to at least one generator of the generator system when it is driven in rotation while the vehicle is supported by the fixed support.

* * * * *